US005468518A

United States Patent [19]

Lein et al.

[11] Patent Number: 5,468,518

[45] Date of Patent: Nov. 21, 1995

[54] COMBINED PRIMER/BASECOAT ISLAND COATING SYSTEM

[75] Inventors: Maureen M. Lein, Chester; Richard C. Eisfeller, Greenland; Alfred T. Poliquin, Dover; Mark Burns, Rochester; John T. Russell, Dover, all of N.H.

[73] Assignee: Davidson Textron Inc., Dover, N.H.

[21] Appl. No.: 248,957

[22] Filed: May 25, 1994

[51] Int. Cl.[6] ..... B05D 1/02; B05D 3/00

[52] U.S. Cl. ..... 427/421; 427/404; 427/405; 427/409; 427/412.1; 427/412.3; 427/412.5; 427/295; 427/296

[58] Field of Search ..... 427/409, 412.1, 427/412.3, 412.5, 404, 405, 421, 406, 350, 295, 296

[56] References Cited

U.S. PATENT DOCUMENTS

| | | | |
|---|---|---|---|
| 2,992,125 | 7/1961 | Fustier | 117/7 |
| 2,993,806 | 7/1961 | Fisher et al. | 117/71 |
| 3,118,781 | 1/1964 | Downing | 117/33.3 |
| 3,904,796 | 9/1975 | Zorn et al. | 427/389.9 |
| 3,914,472 | 10/1975 | Nakanishi et al. | 427/250 |
| 4,101,698 | 7/1978 | Dunning et al. | 428/31 |
| 4,131,530 | 12/1978 | Blum et al. | 204/192 |
| 4,211,822 | 7/1980 | Kurfman et al. | 428/412 |
| 4,215,170 | 7/1980 | Oliva | 428/328 |
| 4,254,168 | 3/1981 | Monson | 427/409 |
| 4,369,225 | 1/1983 | Manabe et al. | 427/409 |
| 4,407,871 | 10/1983 | Eisfeller | 428/31 |
| 4,410,597 | 10/1983 | Nishino | 427/409 |
| 4,431,711 | 2/1984 | Eisfeller | 428/31 |
| 4,713,143 | 12/1987 | Eisfeller | 156/655 |
| 4,846,946 | 7/1989 | Mauer et al. | 427/407.1 |
| 5,284,679 | 2/1994 | Eisfeller et al. | 427/240 |
| 5,290,635 | 3/1994 | Eisfeller | 428/216 |
| 5,320,869 | 6/1994 | Eisfeller et al. | 427/412.1 |
| 5,384,161 | 1/1995 | Eisfeller et al. | 427/405 |
| 5,393,568 | 2/1995 | Valente et al. | 427/385.5 |

OTHER PUBLICATIONS

*Thim Film Phenomena,* Kasturi L. Chopra, Robert E. Kreiger Publishing Co., Huntington, N.Y., 1979. pp. 163–189. ( No month available).

*Handbook of Thin Film Technology,* Leon I. Maisell and Reinhard Glang, McGraw–Hill Book Co., New York, N.Y., 1970, pp. 8–32 to 8–43. (no month available).

*Primary Examiner*—Diana Dudash

*Attorney, Agent, or Firm*—Reising, Ethington, Barnard & Perry

[57] ABSTRACT

A process for manufacturing a metallized part comprises the following steps. A part is provided made from a substrate material selected from the group consisting of thermoplastic urethane (TPU), TPU alloys, polyester alloys, nylon, thermoplastic olefins (TPO) and aluminum. A single protective layer (combined primer/basecoat) is spray deposited, flashed and cured over the substrate. Over the combined primer/basecoat layer, a layer of corrosion prone metal is vacuum deposited to form a discontinuous film covering the combined primer/basecoat layer. A layer of clear resinous protective dielectric topcoat is spray deposited and cured to completely cover the layer of vacuum deposited corrosion prone metal material and fill channels formed in the discontinuous film layer.

1 Claim, 1 Drawing Sheet

COMBINED PRIMER/BASECOAT ISLAND COATING SYSTEM

TECHNICAL FIELD

This invention pertains to vacuum deposition of amphoteric materials.

BACKGROUND OF THE INVENTION

Vacuum metallizing of plastic and similar dielectric substrates is disclosed in various forms including U.S. Patents:

| | |
|---|---|
| 2,992,125 | Fustier |
| 2,993,806 | Fisher |
| 3,118,781 | Downing |
| 3,914,472 | Nakanishi |
| 4,101,698 | Dunning |
| 4,131,530 | Blum |
| 4,211,822 | Kaufman |
| 4,215,170 | Oliva |

In addition, two reference books are:

*Thin Film Phenomena*, Kasturi L. Chopra, Robert E. Kreiger Publishing Company, Huntington, N.Y., 1979. pp. 163–189.

*Handbook of Thin Film Technology*, Leon I. Maissel and Reinhard Glang, McGraw-Hill Book Company, New York, N.Y., 1970., pp. 8–32 to 8–43.

U.S. Pat. Nos. 4,407,871, 4,431,711 and 4,713,143, assigned to assignee of the present invention and incorporated herein by reference, relate to metallizing of plastic articles and more particularly to the structure and spacing of discrete metal islands used to metallize, rather than a continuous metal film. The metallizing is performed utilizing the island coating system as detailed in the aforesaid patents. The system includes generally separate primer and basecoat coating layers, a metallizing layer and a topcoat layer. As disclosed in the above referenced patents, the coating layers contain non-volatile film forming polymers, generally in the range of 10–30%.

The coating layers of the island coating system are spray applied using compressed air to atomize the coatings. All of the coatings have been applied using a high volume, low pressure spray gun with organic solvents, generally at 70–90% by weight, as carriers for the coatings in order to be effectively deposited. If the mixture is not properly sprayed the aesthetic properties of the metallized appearance are not achieved. The material must be even, yet thick enough to cover surface irregularities and yet island formation must occur.

Following deposition, each coating layer is flashed at ambient temperature for twenty minutes to evaporate solvent. The coating layer is then cured for 30 minutes at an elevated temperature.

In addition to proper deposition of the coating layers, the appearance and performance of the commercial product, the conductivity of the metal layer, the corrosion resistance of the metal layer and/or the adhesion of the top coat all relate to the structure and spacing of the islands. The above referenced patents provide further teachings related to nucleation and film growth to the desired island structure and spacing that achieves these ends.

In U.S. Pat. No. 5,290,625, assigned to the assignee of the present invention and incorporated herein by reference, the above process is applied to aluminum parts. In a copending application, U.S. Ser. No. 08/248,649, filed the same day as the instant application, assigned to the assignee of the present invention and incorporated herein by reference, the technology for coating layer deposition is improved to allow film builds of 1.5 to 2.0 mils eliminating significant coating irregularities.

U.S. Pat. No. 4,431,711 shows the significant difference in performance to be obtained with a vacuum metallized flexible plastic product, top coated, where the metal particles are coalesced only to the island state instead of being allowed to coalesce as a thin continuous metallic film across which electrical conductivity is established.

The '143 patent adds to the process the step of etching the vacuum deposited material with a solvent which slowly dissolves or removes residual amounts of metal from the channels between the distinct islands. This clears the channels exposing additional bonding surfaces on the substrate for increasing the surface area of adhesion between the substrate and a protective dielectric top coat.

Typically, substrate surfaces include surface flaws and molding defects such as blow lines and knit lines. Such flaws can give a "satin" appearance to the product instead of a bright metallic appearance. Such flaws can be covered by the application of a primer layer followed by the basecoat layer as in the present island coating system to provide suitable thickness to correct for such substrate surface flaws. The primer layer provides a smoother surface for the basecoat layer. In general, a coating thickness of 2.0 mils or more for the primer and basecoat layer is usually sufficient to hide the substrate defects. Each individual layer is between 0.5 and 1.2 mils thick, with the combined thickness of at least 2.0 mils and often thicker.

However, having two separately applied layers adds to the cost and weight of the finished product as well as time of production. Two coating layers require two separate spray application steps and two separate flash and curing steps before metallizing. Hence, the cost and time of producing metallized objects is increased. A single thicker layer of either the primer or basecoat layer as formulated in the aforesaid patents did not adequately cover the surface. There was a significant increase of coating defects such as a "satin" appearance and poor appearance quality which can be described as a lack of brightness.

A thicker layer of primer only does not provide the proper surface chemistry upon which to form islands. A thicker layer of basecoat does not provide the necessary black background color such as that provided by the primer which is needed to give good appearance qualities.

An object of the present invention is to eliminate one of the two separate deposition steps of either the primer or basecoat. This would eliminate one set of flash and cure times increasing the efficiency of a production line making the metallized parts by at least 30%. A further object of the present invention is to reduce the cost and weight of a product while retaining the desired bright appearance, i.e. maintaining the aesthetic properties of the metallized appearance. Another object of the present invention is to reduce waste disposal of organic solvents.

SUMMARY OF THE INVENTION AND ADVANTAGES

According to the present invention, a process for manufacturing a metallized part comprises the following steps. A part is provided made from a substrate material selected from the group consisting of thermoplastic urethane (TPU), TPU alloys, polyester alloys, nylon, thermoplastic olefins (TPO) and aluminum. A single protective layer (combined primer/basecoat) is spray deposited, flashed and cured over the substrate. The single protective layer has the following formulation of clear urethane resin 20–40%, black pigment paste 10–30%, solvent blend 40–60%, catalyst solution 0.5–2.0%. Its thickness is from 1.0 to 2.0 mils, with 1.5 mils or more preferred.

Over the combined primer/basecoat layer, a layer of corrosion prone metal is vacuum deposited to form a discontinuous film covering the combined primer/basecoat layer. The discontinuous film includes a plurality of discrete islands of the corrosion prone metal material appearing macroscopically as a continuous film of such metal and having a plurality of macroscopically unobservable channels between the islands to maintain the film electrically nonconductive over the combined primer/basecoat layer.

A layer of clear resinous protective dielectric topcoat is spray deposited and cured to completely cover the layer of vacuum deposited corrosion prone metal material and fill the channels. The topcoat bonds the corrosion prone metal material to the combined primer/basecoat layer throughout the bottom of the channels by an adhesion force greater than two orders of magnitude in strength as compared to the adhesion force between the topcoat and a continuous layer of the corrosion prone metal material.

The process provides metallized parts which have a metallic rather than satin appearance and which are more rapidly and cost-effectively produced by eliminating one application of a layer including flash and cure times as well as reducing wastes.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
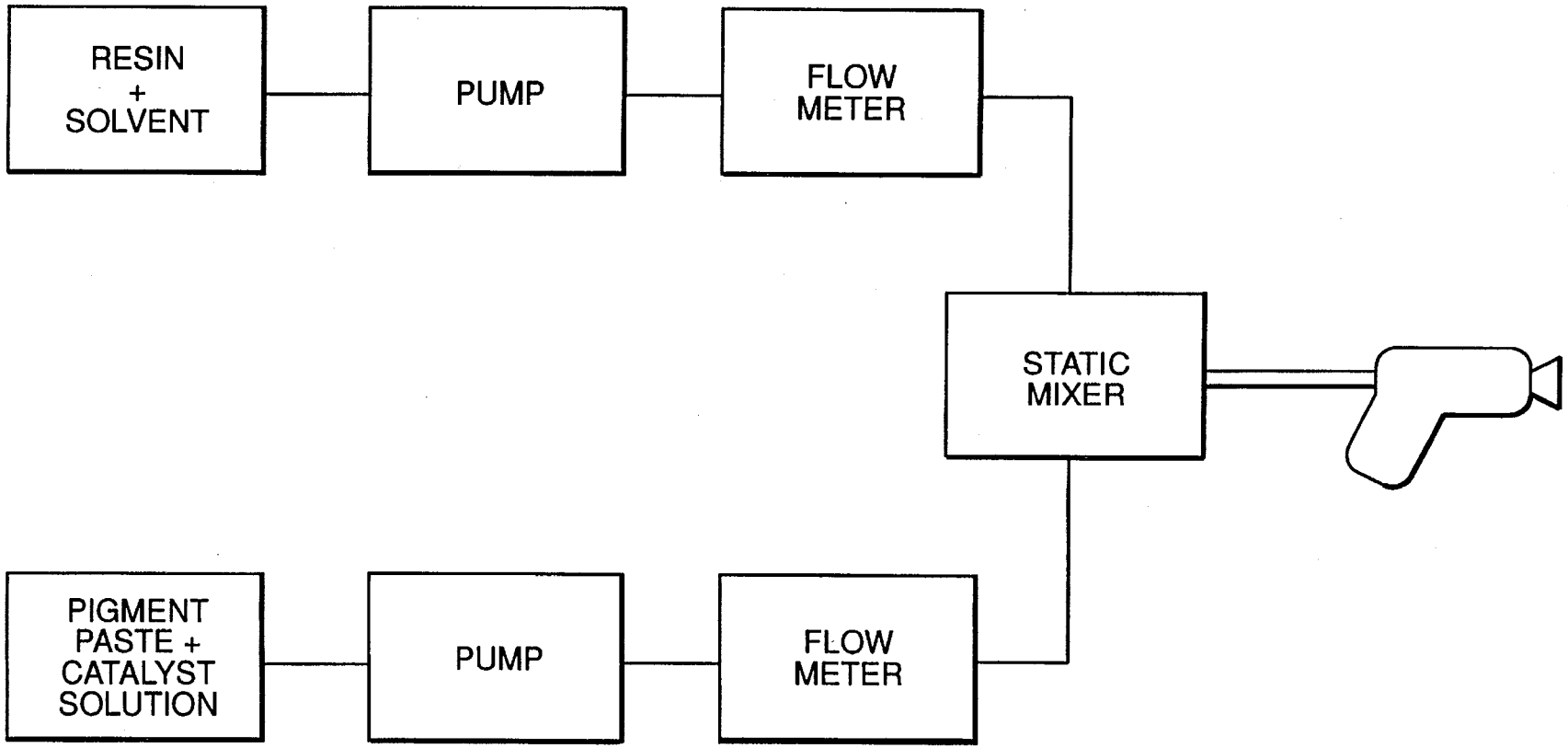
FIG. 1 is a schematic drawing of the two stage metering system for spray deposition of the combined primer/basecoat layer.

The present invention provides a process of manufacturing parts that have a metallized appearance and that are faster and more efficient to produce, that is more cost-effective to produce.

The part can be made from a substrate material selected from the group consisting of thermoplastic urethane (TPU), TPU alloys, polyester alloys, nylon, thermoplastic olefins (TPO) and aluminum.

The island coating system is then applied as taught in U.S. Pat. Nos. 4,407,871, 4,431,711 and 4,713,143 with the improvements disclosed in the present invention as described hereinbelow. The system includes generally a combined primer/basecoat layer as the improvement followed by a metallizing layer and a topcoat layer as taught in the above listed patents.

The combined primer/basecoat layer is a suitable polymer with an additional catalyst. In general the combined primer/basecoat layer consists, by weight of clear urethane resin 20–40%, black pigment paste 10–30%, solvent blend 40–60%, catalyst solution 0.5–2.0%. It was found that the percent catalyst solution had to be increased in order to provide the proper surface chemistry upon which to form islands. This increase in catalyst overcame the inhibition of the primary chemical reaction of the isocyanate groups and the hydroxyl groups of the urethane resin by the presence of carbon black in the pigment dispersion and the dispersed polymeric material. This is not an issue in the separate primary and basecoat applications since the basecoat does not have pigment.

The catalyst is selected from the metal and amine catalysts such as those known in the art found to be effective in urethane reactions.

The combined primer/basecoat layer has a thickness, as applied, of from 1.0 to 2.0 mils with 1.5 mils being the preferred embodiment. In general it was found using separate primer and basecoat layers that the combined thickness of the two layers had to be equal to or greater than 2.0 mils to provide the proper appearance. By using the combined primer/basecoat layer a weight savings of 30% can be achieved.

The combined primer/basecoat layer is not stable if blended more than one hour prior to spray depositing. If all the ingredients are mixed together they become very viscous and gel. The viscosity of the blend must be stable in order for the spray pumps to provide a constant volume of material, thereby providing consistent film builds. Film builds are critical for both appearance and final physical properties of the part. Therefore, as shown in FIG. 1, the mixing is done in two steps. The resin plus solvent mixture is prepared and the pigment paste plus catalyst mixture is prepared. It was found that these two mixtures are stable for more than two days. Immediately before spray depositing, using a two part metering system, the two mixtures are brought together in the proper proportions and spray deposited using a high volume, low pressure application spray technology. Additionally, liquid $CO_2$ as a supplemental carrier can be used as described in the co-pending application filed the same day as the instant application, assigned to the assignee of the present invention and incorporated herein by reference.

The combined primer/base coat layer is covered by a film layer of vacuum metallized metal material islands having a thickness of 25 to 4,000 angstroms, with 500 to 3,000 as the preferred embodiment, and which are formed in accordance with the process set forth in U.S. Pat. No. 4,431,711 that is owned by the assignee of the present invention and whose process is hereby incorporated by reference. The corrosion prone metal material forms a discontinuous film covering the base layer including a plurality of discrete islands of a corrosion prone metal material appearing macroscopically as a continuous film of such metal and having a plurality of macroscopically unobservable channels between the islands to maintain the film electrically nonconductive over the base layer. The metal can be selected from the group consisting of aluminum, cadmium, cobalt, copper, gallium, indium, iron, nickel, tin and zinc, with indium being the preferred embodiment.

In a preferred embodiment the present invention includes the steps of etching the valleys of the metal island coating of the '711 patent by the etching steps set forth in U.S. Pat. No. 4,713,143 also owned by the assignee of the present invention and whose etching steps are also hereby incorporated by reference. In general a solvent slowly dissolves or removes residual amounts of metal from the channels between the distinct islands. This clears the channels exposing additional bonding surfaces on the substrate for increasing the surface area of adhesion between the substrate and a protective dielectric topcoat.

The topcoat layer is formed from a clear resinous protective dielectric plastic material as described in U.S. Pat. No. 4,431,711 and 4,407,871. The topcoat layer generally comprises a solvent solution of a resin selected from the group consisting of acrylics and urethanes. The topcoat also contains from 0.5–3.0% of an UV absorber.

The topcoat layer is spray deposited and cured to completely cover the layer of vacuum deposited corrosion prone metal material and fill the channels. The topcoat bonds the corrosion prone metal material to the combined primer/basecoat layer throughout the bottom of the channels by an adhesion force greater than two orders of magnitude in strength as compared to the adhesion force between the topcoat and a continuous layer of the corrosion prone metal material.

In one embodiment, the dielectric topcoat layer can include a dye to provide a colored appearance. In a second embodiment the underlying combined primer/basecoat can include a pigment to provide a colored metallic appearance as disclosed in U.S. Pat. No. 5,320,869 issued Jun. 14, 1994 and assigned to assignee of the present invention and incorporated herein by reference.

In another embodiment, a further coating consisting of automotive exterior paint can be applied to the topcoat layer.

The combined primer/basecoat layer and topcoat layer generally have a thickness in the range of 1.0 mil to 2.5 mils and can be the same or different. The combined primer/basecoat layer has a preferred thickness of 1.5 mils or greater which contributes to a non-satin appearance, i.e. an appearance without noticeable surface defects.

The process includes a flash step of twenty minutes at ambient temperature followed by curing step after application of each layer. Curing of the combined primer/basecoat layer and topcoat layer is done at 30 minutes at 260° F. By eliminating one layer with its attendant flash and cure times, at least one hour of process time per part is saved, thereby increasing production efficiency by at least 30%.

In a preferred embodiment, the step of spray depositing is done while the part is being rotated as described in the U.S. Pat. No. 5,284,679 issued Feb. 8, 1994 and assigned to the assignee of the present invention, and incorporated herein by reference and at a preferred rotation rate of 2–6 RPM to eliminate satin appearance. In addition a high atomizing air pressure and delivery rate are preferred. Further the step of spray depositing is done while the part is at ambient temperature.

Certain parts may require the step of spray depositing to include spot sanding, or a full sanding, prior to application. The step of etching is done while the part is also rotating.

The invention will now be described by way of the following examples with it being understood that other advantages and a more complete understanding of the invention will be apparent to those skilled in the art from the detailed description of the invention hereto.

EXAMPLES

Tables 1–3 provide examples of parts that were prepared with the present invention and tested to meet performance standards. These results are compared to separate primer and basecoat layers as shown in Table 4 and in column 5 of Table 2.

Table 1 presents the results of parts tested to meet General Motors specification 4388. The substrate that was coated is indicated. Table 2 presents the results of parts tested to meed Ford Motor Company specification ESB-M5P10-A while Table 3 lists the results of tests to meet Chrysler Company specification MS-PP11-5.

Where parts are the same type they are referred to with the same letter. In Tables 3 and 4, the failures for acid resistance are generally accepted by Chrysler as typical results for this severe test. The abbreviation WIP refers to work in progress.

As the data shows, the combined primer/basecoat performed as well or better than the separate primer and basecoat layers.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

TABLE 1

| | CUSTOMER SPEC GM 4388 | | | |
|---|---|---|---|---|
| TEST METHOD | A POLYESTER ALLOY | B POLYESTER ALLOY | C TPU | D POLYESTER ALLOY |
| 1. ADEQUACY OF CURE GM 9509-P | PASS | PASS | PASS | PASS |
| 2. TAPE ADHESION GM 9071-P MET. A | PASS | PASS | PASS | PASS |
| 3. CROSS CUT TAPE GM 9071-P MET. B | PASS | PASS | PASS | PASS |
| 4. DIME SCRAPE GM 9506-P | N/A | N/A | PASS | PASS |
| 5. KNIFE CROSS HATCH GM 9502-P | PASS-10 | PASS-10 | PASS-10 | PASS-10 |
| 6. CHIP RESISTANCE GM 9508-P | PASS-9 | PASS-9 | PASS-9 | PASS-9 |
| 7. MOISTURE RESIST. GM 4465-P MET. A | PASS | PASS | PASS | PASS |
| 8. CROSS HATCH TAPE ADHESION GM 9071-P MET. A | PASS | PASS | PASS | PASS |
| 9. CROSS CUT TAPE ADHESION GM 9071-P MET. B | PASS | PASS | PASS | PASS |
| 10. DIME SCRAPE GM 9506-P | N/A | N/A | PASS | PASS |
| 11. KNIFE CROSS HATCH GM 9502-P | PASS-10 | PASS-10 | PASS-10 | PASS-10 |
| 12. HEAT RESIST 7 DAYS @ 158° F. | PASS | PASS | PASS | PASS |
| 13. +CROSS HATCH ADHESION GM 9071-P | PASS | PASS | PASS | PASS |
| 14. +CROSS CUT ADHESION GM 9071-P | PASS | PASS | PASS | PASS |
| 15. DIME SCRAPE GM 9506-P | N/A | N/A | PASS | PASS |
| 16. KNIFE CROSS GM 9502-P | PASS-10 | PASS-10 | PASS-10 | PASS-10 |
| 17. CHIP RESIST GM 9508-P | PASS-9 | PASS-9 | PASS-9 | PASS-9 |
| 18. MOISTURE & COLD CYCLE GM 9505-P | PASS | PASS | PASS | PASS |

TABLE 1-continued

| TEST METHOD | CUSTOMER SPEC GM 4388 A POLYESTER ALLOY | B POLYESTER ALLOY | C TPU | D POLYESTER ALLOY |
|---|---|---|---|---|
| 19. +CROSS HATCH ADH GM 9071-P MET. A | PASS | PASS | PASS | PASS |
| 20. +CROSS CUT ADH GM 9071-P MET. B | PASS | PASS | PASS | PASS |
| 21. +DIME SCRAPE GM 9506-P | N/A | N/A | PASS | PASS |
| 22. +KNIFE CROSS HATCH GM 9502-P | PASS-10 | PASS-10 | PASS-10 | PASS-10 |
| 23. FUEL RUB DIP GM 9501-P | PASS | FAIL | PASS | PASS |
| 24. FUEL RESIST PUDDLE GM 9500-P | PASS | FAIL | PASS | PASS |
| 25. FLEXIBILITY @ 71.6° F. GM 9503-P | PASS-10 | PASS-10 | PASS-10 | PASS-10 |
| 26. FLEXIBILITY @ 4.9° F. GM 9503-P | PASS-10 | PASS-10 | PASS-10 | PASS-10 |
| 27. FLEXIBILITY @ −22° F. GM 9503-P | PASS-10 | PASS-10 | PASS-10 | PASS-10 |
| 29. WEATHER RESIST SAE J1976 | WIP | WIP | WIP | WIP |

TABLE 2

| TEST METHOD | CUSTOMER SPEC FORD ESB-M5P10-A A POLYESTER ALLOY | B POLYESTER ALLOY | E POLY-ESTER ALLOY | D POLYESTER ALLOY | F TPU |
|---|---|---|---|---|---|
| 3. INITIAL ADH BI 106-01 MET. B | PASS | PASS | PASS | PASS | PASS |
| 4. FLEXIBILITY @ 73.4° F. 13 MM MANDREL | PASS | N/A | N/A | PASS | PASS |
| 5. FLEXIBILITY @ 73.4° F. 25 MM MANDREL | N/A | PASS | PASS | N/A | PASS |
| 6. COLD FLEX @ −4.0° F. ½ × 6 MIN | PASS | PASS | PASS | PASS | PASS |
| 7. TOPCOAT STABILITY 24 H/100° F. | PASS | PASS | PASS | PASS | PASS |
| 8. CHIP RESIST SAE J400 | PASS-7 | PASS-10 | PASS-7 | PASS-8 | PASS |
| 9. WATER RESIST BI 104-01 | PASS | PASS | PASS | PASS | PASS |
| 10. HUMIDITY ASTM D2247 | PASS | PASS | PASS | PASS | PASS |
| 11. WAX RESIST B4A-19534AA WAX | PASS | PASS | PASS | PASS | PASS |
| 13. ADHESION AFT WAX RESIST BI 106-01 | PASS | PASS | PASS | PASS | PASS |
| 14. TAR & ROAD OIL REM. B7A-19520AA | PASS | PASS | PASS | PASS | PASS |
| 16. ADHESION AFT TAR & OIL BI 106-01 | PASS | PASS | PASS | PASS | PASS |
| 17. CLEANER WAX & POLISH B8A-19523AA | PASS | PASS | PASS | PASS | PASS |
| 19. ADHESION AFT CLEAN. WAX & POLISH BI 106-01 | PASS | PASS | PASS | PASS | PASS |
| 20. LIQUID DETERGENT UNDILUTED | PASS | PASS | PASS | PASS | PASS |
| 22. ADH. AFT LIQ. DETERGENT REST. BI 106-01 | PASS | PASS | PASS | PASS | PASS |
| 23. WATER & SPOT SOAP BI 113-01 | PASS | PASS | PASS | PASS | PASS |
| 24. GASOLINE REST. 2 TO 5 ML M14J507 | PASS | PASS | PASS | PASS | PASS |
| 25. OIL REST. 2 TO 5 ML ROTUNDA MOTOR OIL | PASS | PASS | PASS | PASS | PASS |
| 26. SCUFFING RESIST BN 108-04 HEAT "A" | PASS | PASS | PASS | PASS | PASS |
| 27. WEATHERING RES. FLA. 5° SO. FLA. 12 MOS. | WIP | WIP | WIP | WIP | PASS |
| 30. WEATHERING RES. FLA 5° SO. FLA. 24 MOS. | WIP | WIP | WIP | WIP | PASS |
| 33. XENON WEO. 1000 HRS. BO 101-01 | PASS | PASS | PASS | PASS | WIP |
| 35. FLEXIBILITY @ 73.4° F. 25 MM MANDREL | N/A | PASS | PASS | N/A | PASS |
| 36. INITIAL HARDNESS WITHSTAND NORMAL S & H | PASS | PASS | PASS | PASS | N/A |

TABLE 3

CUSTOMER SPEC CHRYSLER MS-PP11-5

| TEST METHOD | F TPU | K POLYESTER ALLOY | C TPU | D POLYESTER ALLOY | E POLYESTER ALLOY |
|---|---|---|---|---|---|
| 1. INITIAL ADHESION 463PB-15-01 X SCRIBE | PASS | PASS | PASS | PASS | PASS |
| 2. INITIAL ADHESION 463PB-15-01 GRID | PASS | PASS | PASS | PASS | PASS |
| 3. INITIAL ADHESION 463PB-15-01 30 DEGREE | PASS | PASS | PASS | PASS | PASS |
| 4. INITIAL ADHESION 463PB-15-01 90 DEGREE | PASS | PASS | PASS | PASS | PASS |
| 5. ADHESION BEFORE HUMIDITY 463PB-9-01 | PASS | PASS | PASS | PASS | PASS |
| 6. HUMIDITY 463-PB-9-01 | PASS | PASS | PASS | PASS | PASS |
| 7. ADHESION AFTER HUMIDITY 463-PB-9-01 | PASS | PASS | PASS | PASS | PASS |
| 8. SALT SPRAY 463-PB-10-01 240 HRS. | N/A | N/A | N/A | PASS | PASS |
| 9. FADEOMETER 463-PB-17-01 240 HRS. FAD-R | PASS | PASS | PASS | PASS | PASS |
| 10. WEATHEROMETER 463-PB-16-02 240 HRS XW | PASS | N/A | N/A | PASS | PASS |
| 11. QUV ASTM G53-84 1000 HRS. | PASS | FAIL | N/A | FAIL | FAIL |
| 12. FLORIDA 12 MO. 463-PB-34-01 5° SO | WIP | N/A | N/A | WIP | WIP |
| 13. FLORIDA 24 MO. 463-PB-34-01 5° SO | WIP | N/A | N/A | WIP | WIP |
| 14. FLORIDA 36 MO. 463-PB-34-01 5° SO | WIP | N/A | N/A | WIP | WIP |
| 15. CYCLING 15 CYCLES 463-PB-22-01 MET. IV | PASS | PASS | PASS | PASS | PASS |
| 16. MAR RESISTANCE 463-PB-43-01 | PASS | PASS | PASS | PASS | PASS |
| 17. SOAP & WATER RESISTANCE 463-PB-8-01 | PASS | FAIL | FAIL | PASS | FAIL |
| 18. SOLVENT WIPE 463-PB-7-01 NAPHTHA MS 1316 | PASS | PASS | PASS | PASS | PASS |
| 19. ACID RESIST 463-PB-6-01 0.5% HCL | FAIL | FAIL | FAIL | FAIL | FAIL |
| 20. ACID RESIST 463-PB-6-01 1.0% HCL | FAIL | FAIL | FAIL | FAIL | FAIL |
| 21. ACID RESIST 463-PB-6-01 2.0% HCL | FAIL | FAIL | FAIL | FAIL | FAIL |
| 22. ACID RESIST 463-PB-6-01 4.0% HCL | FAIL | FAIL | FAIL | FAIL | FAIL |
| 23. ACID RESIST 463-PB-6-01 10% HCL 90 MIN. | PASS | PASS | PASS | PASS | PASS |
| 24. ACID RESIST 463-PB-6-01 10% HCL 30 MIN. | PASS | PASS | PASS | PASS | PASS |
| 25. ACID RESIST 463-PB-6-01 1.0% SULFURIC 16 HRS | PASS | PASS | PASS | PASS | PASS |
| 26. ACID RESIST 463-PB-6-01 1.0% NAOH 60 MIN | PASS | PASS | PASS | PASS | PASS |
| 27. CHIPPING @ RT 463-PB-39-01 1 PT. | PASS-7 | PASS-10 | PASS-10 | PASS-7 | PASS-9 |
| 28. CHIPPING @ 0° F. 463-PB-39-01 1 PT. | FAIL-5 | PASS-10 | PASS-9 | FAIL-6 | PASS-8 |
| 29. TABER WEAR ASTM D4060-81 200 CYCLES | N/A | PASS | PASS-9 | PASS | PASS |
| 30. IMPACT RESISTANCE 463-PB-19-01 80 IN/LBS | PASS | PASS | PASS | PASS | PASS |

| TEST METHOD | G TPO | G TPO | H TPO | H TPO |
|---|---|---|---|---|
| 1. INITIAL ADH. 463PB-15-01 X-SCRIBE | PASS | PASS | PASS | PASS |
| 2. INITIAL ADH. 463PB-15-01 GRID | PASS | PASS | PASS | PASS |
| 3. INITIAL ADH. 463PB-15-01 30 DEGREE | PASS | PASS | PASS | PASS |
| 4. INITIAL ADH. 463PB-15-01 90 DEGREE | PASS | PASS | PASS | PASS |
| 5. ADH. BEFORE HUMIDITY 463-PB-9-01 | PASS | PASS | PASS | PASS |
| 6. HUMIDITY 463-PB-9-01 240 HRS. | PASS | PASS | PASS | PASS |
| 7. ADH. AFTER HUMIDITY 463-PB-9-01 IMMED. | PASS | PASS | PASS | PASS |
| 9. FADEOMETER 463-PB-17-01 240 HOURS | PASS | PASS | PASS | PASS |
| 10. WEATHEROMETER 463-PB-16-01 240 HOURS | PASS | PASS | PASS | PASS |
| 11. QUV ASTM G53-84 1000 HOURS | PASS | PASS ADH; HAZY | PASS | PASS |
| 12. FLORIDA 12 MO EXP. 463-PB-34-01 5° SO | WIP | WIP | WIP | WIP |
| 13. FLORIDA 24 MO EXP. 463-PB-34-01 5° SO | WIP | WIP | WIP | WIP |
| 14. FLORIDA 36 MO EXP. 463-PB-34-01 5° SO | WIP | WIP | WIP | WIP |
| 15. CYCLING 15 CYCLES 463-PB-22-01 METH. IV | PASS | PASS | PASS | PASS |
| 16. MAR RESISTANCE 463-PB-43-01 | PASS | PASS | PASS | PASS |
| 17. SOAP & WATER RESIST. 463-PB-8-01 | PASS | PASS | PASS | PASS |
| 18. SOLVENT WIPE 463-PB-7-01 NAPTHA | PASS | PASS | PASS | PASS |
| 19. ACID RESIST 463-PB-6-01 0.5% HCL | FAIL | FAIL | FAIL | FAIL |
| 20. ACID RESIST 463-PB-6-01 1.0% HCL | FAIL | FAIL | FAIL | FAIL |
| 21. ACID RESIST 463-PB-6-01 2.0% HCL | FAIL | FAIL | FAIL | FAIL |
| 22. ACID RESIST 463-PB-6-01 4.0% HCL | FAIL | FAIL | FAIL | FAIL |
| 23. ACID RESIST 463-PB-6-01 10% HCL 90 MIN. | PASS | PASS | PASS | PASS |
| 24. ACID RESIST 463-PB-6-01 10% NIT. 30 MIN. | PASS | PASS | PASS | PASS |
| 25. ACID RESIST 463-PB-6-01 1.0% SUL. 16 HRS. | PASS | PASS | PASS | PASS |
| 26. ACID RESIST 463-PB-6-01 1.0% SOD. HY. 60 MIN. | PASS | PASS | PASS | PASS |
| 27. CHIPPING @ RT. 463-PB-39-01 1 PT. | PASS-8 | FAIL-6 | PASS-8 | PASS-8 |
| 28. CHIPPING @ 0° F. 463-PB-39-01 1 PT. | PASS-8 | FAIL-6 | FAIL-6 | PASS-7 |
| 29. TABER WEAR ASTM D4060-81 200 CYCLES | PASS | PASS | PASS | PASS |
| 30. IMPACT RESIST. 463-PB-19-01 80 IN/LBS | PASS | PASS | PASS | PASS |

| TEST METHOD | I TPO | I TPO | J TPO | K TPO |
|---|---|---|---|---|
| 1. INITIAL ADH. 463PB-15-01 X-SCRIBE | PASS | PASS | PASS | PASS |
| 2. INITIAL ADH. 463PB-15-01 GRID | PASS | PASS | PASS | PASS |
| 3. INITIAL ADH. 463PB-15-01 30 DEGREE | PASS | PASS | PASS | PASS |
| 4. INITIAL ADH. 463PB-15-01 90 DEGREE | PASS | PASS | PASS | PASS |
| 5. ADH. BEFORE HUMIDITY 463-PB-9-01 | PASS | PASS | PASS | PASS |
| 6. HUMIDITY 463-PB-9-01 240 HRS. | PASS | PASS | PASS | PASS |

TABLE 3-continued

| CUSTOMER SPEC CHRYSLER MS-PP11-5 | | | | |
|---|---|---|---|---|
| 7. ADH. AFTER HUMIDITY 463-PB-9-01 IMMED. | PASS | PASS | PASS | PASS |
| 9. FADEOMETER 463-PB-17-01 240 HOURS | PASS | PASS | PASS | PASS |
| 10. WEATHEROMETER 463-PB-16-01 240 HOURS | PASS | PASS | PASS | PASS |
| 11. QUV ASTM G53-84 1000 HRS. | PASS | PASS | PASS | PASS |
| 12. FLORIDA 12 MO EXP. 463-PB-34-01 5° SO | WIP | WIP | WIP | WIP |
| 13. FLORIDA 24 MO EXP. 463-PB-34-01 5° SO | WIP | WIP | WIP | WIP |
| 14. FLORIDA 36 MO EXP. 463-PB-34-01 5° SO | WIP | WIP | WIP | WIP |
| 15. CYCLING 15 CYCLES 463-PB-22-01 METH. IV | PASS | PASS | PASS | PASS |
| 16. MAR RESISTANCE 463-PB-43-01 | PASS | PASS | PASS | PASS |
| 17. SOAP & WATER RESIST. 463-PB-8-01 | PASS | PASS | PASS | PASS |
| 18. SOLVENT WIPE 463-PB-7-01 NAPTHA | PASS | PASS | PASS | PASS |
| 19. ACID RESIST 463-PB-6-01 0.5% HCL | FAIL | FAIL | FAIL | FAIL |
| 20. ACID RESIST 463-PB-6-01 1.0% HCL | FAIL | FAIL | FAIL | FAIL |
| 21. ACID RESIST 463-PB-6-01 2.0% HCL | FAIL | FAIL | FAIL | FAIL |
| 22. ACID RESIST 463-PB-6-01 4.0% HCL | FAIL | FAIL | FAIL | FAIL |
| 23. ACID RESIST 463-PB-6-01 10% HCL 90 MIN. | PASS | PASS | PASS | PASS |
| 24. ACID RESIST 463-PB-6-01 10% NIT. 30 MIN. | PASS | PASS | PASS | PASS |
| 25. ACID RESIST 463-PB-6-01 1.0% SUL. 16 HRS. | PASS | PASS | PASS | PASS |
| 26. ACID RESIST 463-PB-6-01 1.0% NAOH 60 MIN. | PASS | PASS | PASS | PASS |
| 27. CHIPPING @ RT. 463-PB-39-01 1 PT. | PASS-8 | PASS-8 | PASS-7 | PASS-8 |
| 28. CHIPPING @ 0° F. 463-PB-39-01 1 PT. | PASS-6 | FAIL-6 | FAIL-6 | FAIL-6 |
| 29. TABER WEAR ASTM D4060-81 200 CYCLES | PASS | PASS | PASS | PASS |
| 30. IMPACT RESISTANCE 463-PB-19-01 80 IN/LBS | PASS | PASS | PASS | PASS |

TABLE 4

| CUSTOMER SPEC CHRYSLER MS-PP11-5 SEPARATE PRIMER/BASECOAT | | | | |
|---|---|---|---|---|
| TEST METHOD | G TPO | G TPO | K TPO | L TPU |
| 1. INITIAL ADH. 463PB-15-01 X-SCRIBE | PASS | PASS | PASS | PASS |
| 2. INITIAL ADH. 463PB-15-01 GRID | PASS | PASS | PASS | PASS |
| 3. INITIAL ADH. 463PB-15-01 30 DEGREE | PASS | PASS | PASS | PASS |
| 4. INITIAL ADH. 463PB-15-01 90 DEGREE | PASS | PASS | PASS | PASS |
| 5. ADH. BEFORE HUMIDITY 463-PB-9-01 | PASS | PASS | PASS | PASS |
| 6. HUMIDITY 463-PB-9-01 240 HRS. | PASS | PASS | PASS | PASS |
| 7. ADH. AFTER HUMIDITY 463-PB-9-01 IMMED. | PASS | PASS | PASS | PASS |
| 9. FADEOMETER 463-PB-17-01 240 HOURS | PASS | PASS | PASS | PASS |
| 10. WEATHEROMETER 463-PB-16-01 240 HOURS | PASS | PASS | PASS | PASS |
| 11. QUV ASTM G53-84 1000 HRS. | PASS | PASS | PASS | PASS |
| 12. FLORIDA 12 MO EXP. 463-PB-34-01 5° SO | PASS | PASS | PASS | PASS X; 16% MTXH |
| 13. FLORIDA 24 MO EXP. 463-PB-34-01 5° SO | WIP | WIP | WIP | WIP |
| 14. FLORIDA 36 MO EXP. 463-PB-34-01 5° SO | WIP | WIP | WIP | WIP |
| 15. CYCLING 15 CYCLES 463-PB-22-01 METH. IV | PASS | PASS | PASS | PASS |
| 16. MAR RESISTANCE 463-PB-43-01 | PASS | PASS | PASS | PASS |
| 17. SOAP & WATER RESIST. 463-PB-8-01 | PASS | PASS | PASS | PASS |
| 18. SOLVENT WIPE 463-PB-7-01 NAPTHA | PASS | PASS | PASS | PASS |
| 19. ACID RESIST 463-PB-6-01 0.5% HCL | FAIL | FAIL | FAIL | FAIL |
| 20. ACID RESIST 463-PB-6-01 1.0% HCL | FAIL | FAIL | FAIL | FAIL |
| 21. ACID RESIST 463-PB-6-01 2.0% HCL | FAIL | FAIL | FAIL | FAIL |
| 22. ACID RESIST 463-PB-6-01 4.0% HCL | FAIL | FAIL | FAIL | FAIL |
| 23. ACID RESIST 463-PB-6-01 10% HCL 90 MIN. | PASS | PASS | PASS | PASS |
| 24. ACID RESIST 463-PB-6-01 10% NIT. 30 MIN. | PASS | PASS | PASS | PASS |
| 25. ACID RESIST 463-PB-6-01 1.0% SUL. 16 HRS. | PASS | PASS | PASS | PASS |
| 26. ACID RESIST 463-PB-6-01 1.0% SOD. HY. 60 MIN. | PASS | PASS | PASS | FAIL |
| 27. CHIPPING @ RT. 463-PB-39-01 1 PT. | PASS-8 | PASS-7 | PASS-8 | PASS-8 |
| 28. CHIPPING @ 0° F. 463-PB-39-01 1 PT. | PASS-8 | PASS-7 | PASS-7 | PASS-7 |
| 29. TABER WEAR ASTM D4060-81 200 CYCLES | PASS | PASS | PASS | PASS |
| 30. IMPACT RESISTANCE 463-PB-19-01 80 IN/LBS | PASS | PASS | PASS | PASS |

What is claimed is:

1. A process for manufacturing a metallized part comprising the steps of:

providing a part, as a substrate, made from a material selected from the group consisting of thermoplastic urethanes, thermoplastic urethane alloys, polyester alloys, thermoplastic olefins and aluminum;

spray depositing directly on the substrate a combined primer/basecoat layer consisting of, by weight, a polymer material clear urethane resin 20–40%, black pigment paste 10–30%, solvent blend 40–60% including a catalyst 0.5–2.0% selected from the group consisting of metal and amine catalysts, covering the substrate, flashing and curing the combined primer/basecoat layer;

vacuum depositing directly on the combined primer/basecoat layer a layer of a corrosion prone metal material to form a discontinuous film covering the combined primer/basecoat layer including a plurality of discrete islands of the corrosion prone metal material appearing macroscopically as a continuous film of such metal and having a plurality of macroscopically unobservable channels between the islands to maintain the film electrically non-conductive over the combined primer/basecoat layer; and spray depositing a layer of clear resinous protective dielectric topcoat to completely cover the layer of vacuum deposited corrosion prone metal material and filling the channels for bonding the corrosion prone metal material to the base layer throughout the bottom of the channels by an adhesion force greater than two orders of magnitude in strength as compared to the adhesion force between the topcoat and a continuous layer of the corrosion prone metal material, flashing and curing the topcoat layer.

* * * * *